United States Patent [19]

Rutter

[11] 4,018,179

[45] Apr. 19, 1977

[54] PONTOON SYSTEM FOR SUPPORTING WATERCRAFT ON A BODY OF WATER

[75] Inventor: Henry A. Rutter, Claremore, Okla.

[73] Assignee: National Hydro-Hoist Company, Claremore, Okla.

[22] Filed: Nov. 28, 1975

[21] Appl. No.: 635,861

[52] U.S. Cl. ..... 114/45; 61/65

[51] Int. Cl.[2] ..... B63C 1/06

[58] Field of Search ..... 114/.5 BD, .5 R, .5 F, 114/.5 D, .5 T, 44–48, 52, 61, 123, 125, 49; 214/1 A; 61/64–65; 9/1 T

[56] References Cited

UNITED STATES PATENTS

| | | | |
|---|---|---|---|
| 1,372,394 | 3/1921 | Beckert | 114/46 |
| 3,315,627 | 4/1967 | Roberts | 114/45 |
| 3,362,172 | 1/1968 | Rutter | 214/1 A |
| 3,448,712 | 6/1969 | Lehmann et al. | 114/44 |
| 3,603,276 | 9/1971 | De Lisle | 114/.5 BD |
| 3,727,415 | 4/1973 | Williams | 61/65 |
| 3,895,592 | 7/1975 | King | 114/45 |

*Primary Examiner*—Trygve M. Blix
*Assistant Examiner*—Stuart M. Goldstein
*Attorney, Agent, or Firm*—William S. Dorman

[57] ABSTRACT

A pontoon system for supporting watercraft on a body of water having a submersible structure comprised of pontoons into which air is injected expelling the water therefrom to provide lift for the system, and a frame which maintains the pontoons in fixed spaced relationship. The frame includes support pads which extend upwardly therefrom and which contact the hull and keel of the watercraft for support purposes. The pontoons are divided into chambers by bulkheads which allow the water to be forced from the front portion of the pontoons first. Thus, the front of the watercraft is lifted initially which stabilizes the watercraft and the pontoon system before the usually heavier aft portion of the watercraft is lifted; this reduces the possibility that the watercraft will become unstable during the lifting process. Air may be released from said pontoons for lowering the pontoon system into the water. A safety system is provided to lower the system into the water if a leak develops.

8 Claims, 6 Drawing Figures

PONTOON SYSTEM FOR SUPPORTING WATERCRAFT ON A BODY OF WATER

BACKGROUND OF THE INVENTION

1. Field of the Invention

The present invention relates to a pontoon system which acts as a floating support for watercraft. More particularly, the present invention relates to a pontoon system for lifting and supporting watercraft which stabilizes the watercraft during the lifting process by lifting the lighter (front) portion of the watercraft before lifting the heavier (rear) portion.

2. Description of the Prior Art

Reference is made to the following U.S. patents as typifying the structure of dry docks and pontoon systems for watercraft:

Lehmann 3,448,712; and

Roberts 3,315,627.

The Roberts patent shows and describes a floating dry dock with both rigid and inflatable pontoons. Air is introduced into the various pontoons thereby creating lift. The pontoons extend the length of the dry dock structure without any intervening bulkheads. The water may be expelled from any particular pontoon by opening the valve between the compressed air supply and the pontoon.

The Lehmann patent shows and describes a dock using pontoons for use mainly as a towing apparatus. The pontoons have two chambers. One chamber is sealed and contains air. Water may be selectively expelled from the second chamber but the bow of the dock will remain above the surface of the water. These prior constructions did not allow for a controllable lifting of the bow of the watercraft before lifting the aft portion and did not utilize a chambered pontoon that allows water to be selectively expelled from all of the chambers. Because of the failure to lift the lighter (which is usually the bow) portion of the watercraft prior to lifting the heavier (which is usually the stern) portion of the watercraft, instability could result in a tipping over resulting in damage to the watercraft.

SUMMARY OF THE INVENTION

The present invention involves a pontoon system having a frame which holds the pontoons in fixed relation, for example, substantially parallel, to one another. The pontoons are attached to the frame by a series of brackets.

The pontoons are disposed on the frame equidistant from the longitudinal center line of the frame, as regards their corresponding pontoon on the other side, so that the lifting power of the pontoon system is equal on either side of the center line. The plurality of pontoons may be selectively filled with air for raising or elevating the frame. One or more pontoons on either side of the center line of the frame are divided into chambers by bulkheads. An air and watertight seal is provided by the bulkheads between the two chambers of the pontoon. Each chamber may be selectively filled with air for raising or elevating the end of the frame where that chamber is located. This allows one end, usually the front, to be elevated and brought into contact with the watercraft to stabilize the watercraft before elevation of the entire watercraft. The stabilization should normally be of the lighter end of the watercraft (normally the bow).

The pontoons are connected through a series of valves to a compressed air supply. The connection from the valves to the various pontoons and chambers is accomplished by a plurality of hoses. The valve system includes a safety valve system having two presure sensing tubes, one of which is attached to each side of the aft or rear portion of the frame, two stem type valves, and two diaphragms to which the tubes are connected. In the event that one of the pontoons should develop a leak and that side of the frame began to lower into the water, the diaphragm which is connected to the tube on that side would cause a stem valve to vent air from the pontoons on the opposite side when the tube senses some predetermined depth.

The frame is provided with hull supports which extend upward from the main body of the frame to engage the lower portion of the watercraft. Also, the frame is provided with a keel pad which engages the keel of the watercraft. These pads prevent damage to the watercraft which would result from contact with the frame.

Centering guides extend upward from the frame and are of sufficient height to extend above the water even when the frame of the pontoon system is fully submerged and aid in properly positioning the watercraft over the frame.

The frame is also provided with columns which extend upward and have a flat member attached to the top thereof to form form walkways along the outside of the frame parallel to the center line of the frame. Below the flat member of the walkways are attached floats which give buoyancy to the pontoon system even when all is released from the various pontoons and chambers.

DESCRIPTION OF THE PREFERRED EMBODIMENT

Figure 1:
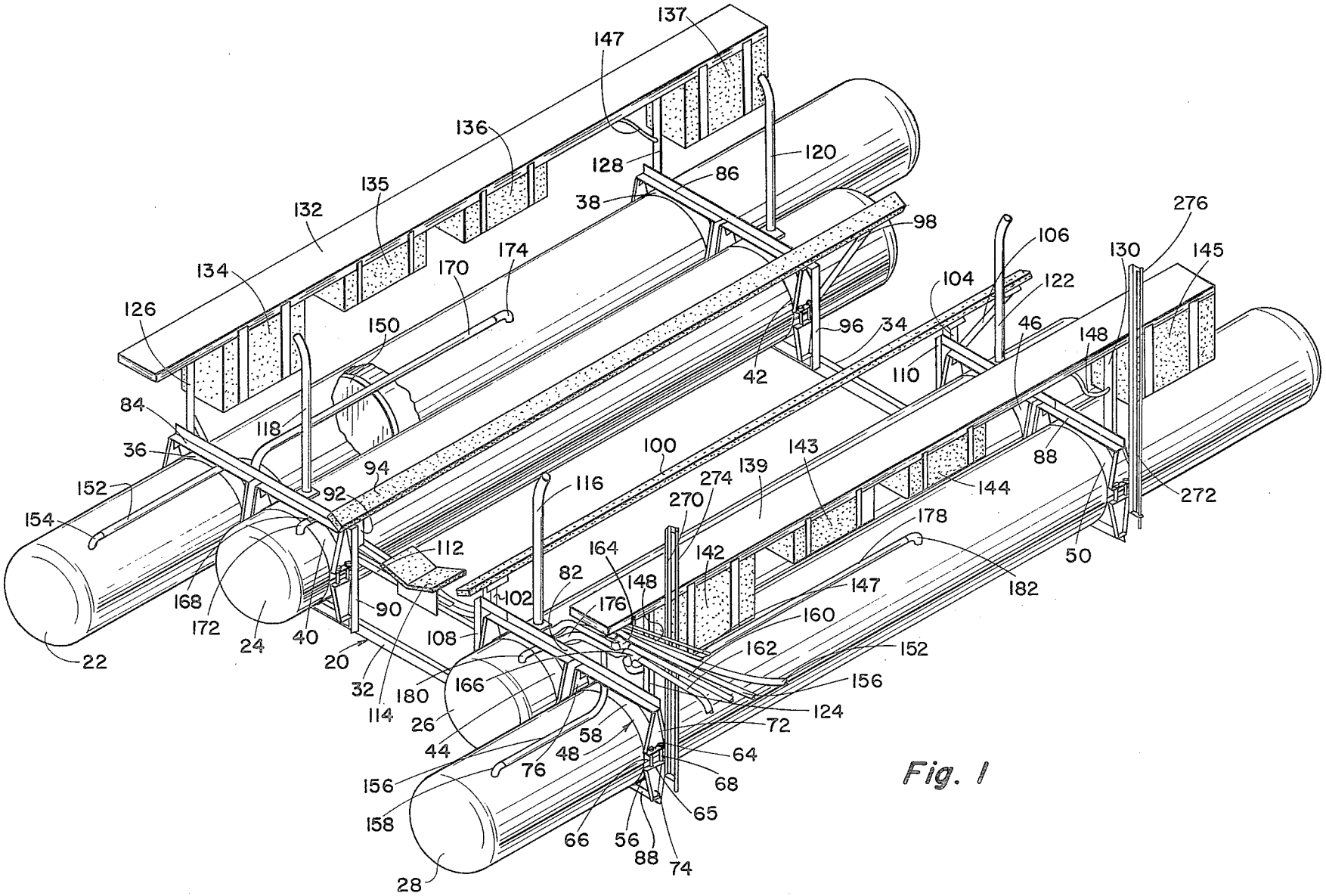
FIG. 1 is a view in perspective of a pontoon docking system constructed according to the present invention.

The pontoon system as shown in FIG. 1 is comprised of a frame (generally designated by the numeral 20) and four tanks or pontoons, 22, 24, 26, and 28. Pontoons 22 and 24 are disposed on one side of the frame 20 and pontoons 26 and 28 on the other. Each pontoon (constructed of fiberglass) is provided with one or more holes in the bottom (not shown in FIG. 6). The main lateral support of the frame 20 is provided by cross members 32 and 34 which extend from outside of the pontoon 22 to the outside of the pontoon 28. The pontoons 22, 24, 26, and 28 are provided with two pontoon brackets each for attachment to the frame 20. Pontoon 22 has pontoon brackets 36 and 38. Pontoon 24 is provided with pontoon brackets 40 and 42. Likewise pontoon 26 has brackets 44 and 46, and pontoon 28 has brackets 48 and 50. All of the pontoon brackets, 36, 38, 40, 42, 44, 46, 48, and 50, are similar in construction. Only bracket 48 will be discussed in detail.

Bracket 48 is composed of two main clamps 56 and 58. These clamps are curved and generally conform to the curvature of the pontoon 28. Each clamp is provided with two ears; clamp 58 is provided with ears 64 and a similar ear at the opposite end of its curved surface (not shown). Clamp 56 is provided with ears 65 and a similar ear at the other end of its curved surface (not shown). The clamps 56 and 58 are placed in a general juxtaposition around pontoon 28 (in approximately the longitudinal position shown in FIG. 1). The ears 64 and 65 are provided with alignment holes and suitable bolts 66 and 68. The bolts 66 and 68 pass through the alignment holes in ears 64 and 65. The similar ears (not shown) of clamps 56 and 58 at the other end of their curved surfaces are also provided with similar alignment holes and bolts (not shown). Suitable nuts are provided fitting on the threaded end of the bolts for tightening the clamps 56 and 58 around pontoon 28.

Braces 72 and 74 extend in a substantially vertical direction from ears 64 and 65, respectively. Brace 72 extends vertically upward from ear 64 and brace 74 extends vertically downward from ear 65. The braces 72 and 74 are attached to clamps 56 and 58 by one of several standard methods, for example, by being welded to their respective ears, 64 and 65. Clamp 58 has a similar brace 76 attached to its opposite ear and clamp 56 has a similar brace (not shown) attached to its opposite ear (in the manner described above). Braces 72 and 76 are attached by some standard method to a tank bracket strip 82, for example, by being provided with alignment holes, nuts, and bolts. The lower braces (only one of which, 74, is shown) are attached to cross member 32.

Pontoon brackets 36, 40 and 44 are attached to cross member 32 in a manner similar to that by which pontoon bracket 48 is attached to cross member 32. Pontoon bracket 44 is attached to bracket strip 82 in a manner similar to the attachment of pontoon bracket 48 thereto. Further, pontoon brackets 38, 42, 46, and 50 are attached to cross member 34 in a manner similar to that by which pontoon bracket 48 is attached to cross member 32. Brackets 36 and 40 are attached to bracket strip 84, brackets 38 and 42 are attached to bracket strip 86, and brackets 46 and 50 are attached to bracket strip 88 in a manner similar to the way in which brackets 44 and 48 are attached to bracket strip 82. The pontoons 22, 24, 26 and 28 are held substantially parallel by the frame 20.

Hull support column 90 is attached to cross member 32 and extends vertically upward and is attached to bracket strip 84. (In general, all attachments are by some standard method, for example, by nuts and bolts.) A hull support riser 92 is attached to hull support column 90 and extends vertically upward from hull support column 90 to which it is attached. Hull support pad 94 is hinged to a hull support riser 92, for example, by a bolt provided with a suitable nut and passing through a loose hole. Hull support pad 94 is hinged to a hull support riser (not shown) which is attached to the hull support column 96. Hull support column 96 is attached to cross member 34 and the bracket strip 86 in a manner similar to the attachment of hull support column 90 to cross member 32 and bracket strip 84. Further, hull support pad 94 is hinged to hull support brace 98 which is attached to hull support column 96 providing additional support to the aft portion of the hull support pad. Hull support pad 100 is hinged to hull support riser 102 and 104 and to hull support brace 106. The ability of the hull support pads 94 and 100 to pivot allows the hull support pads to have a tendency to engage the hull of the watercraft tangentially. The hull support pads are situated an appropriate distance apart to accommodate a particular watercraft and are constructed of a strong but flexible material (for example, wood) to allow them to conform generally to the shape of the hull. Hull support risers 102 and 104 are attached to hull support columns 108 and 110, respectively, which are, in turn, attached to cross members 32 and bracket strip 82, and cross member 34 and pontoon bracket 88, respectively. Keel spanner 112 is attached to support columns 90 and 108 an appropriate distance above cross member 32 (as shown in FIG. 1) to accommodate the keel of a particular watercraft and keel pad 114 is attached in approximately the center of the keel spanner 112. This would be on the longitudinal center line of the frame 20 for the receiving of watercraft. Keel pad 114 has a V shape for engaging and supporting the keel of the watercraft. The hull support pads 94 and 100, and keel pad 114 are made of a material which will minimize the possibility of damage to the watercraft, for example, wood covered with cloth.

Centering guides 116, 118, 120, and 122 are attached to and extend in a substantially vertical direction from bracket strips 82, 84, 86, and 88, respectively. The centering guides are of sufficient length that they will extend above the water even when the pontoon system is in its submerged condition (to be explained in detail hereinafter). The centering guides are constructed of a flexible material (for example, rubber hose) which is sufficiently rigid to support their own weight for extending above the water. The centering guides provide a reference for positioning the watercraft.

Walk columns 124, 126, 128, and 130 also extend upwardly from bracket strips 82, 84, 86, and 88, respectively. The walk columns extend in a substantially vertical upward direction from the outer end of the bracket strips. The upper ends of the walk columns 126 and 128 are attached to a flat member or walkway 132 which has a rectangular shape. Attached to the bottom of walkway 132 is a series of floats 134, 135, 136, and 137.

The opposite side of the pontoon has a similar walkway 139 supported by walk columns 124 and 130 and also provided with floats 142, 143, 144, and 145. The floats 134, 135, 136, 137, 142, 143, 144, and 145 (constructed of a rigid, lightweight cellular polystyrene) are of sufficient buoyancy that they, plus the natural buoyancy of the walkways and the pontoons, even after all the gas has been released from the pontoons (to be explained in detail hereinafter), are sufficient to maintain the pontoon system in a stable submerged condition just below the surface of the water allowing the centering guides to extend above the surface.

Of the safety valve system (to be discusssed in detail hereinafter), only the hoses 147 and 148 are shown in FIG. 1.

The outer pontoons 22 and 28 are provided with bulkheads (only one of which, 150, is shown in FIG. 1) which divide pontoons 22 and 28 into two longitudinally spaced chambers with the bulkhead placed in the approximate position shown in FIG. 1. Each chamber is provided with a hole (not shown) in the bottom thereof. Each interior pontoon 24 and 26 is also provided with a hole in the bottom thereof. Hose 152 (all hoses are constructed of flexible rubber) goes to the forward chamber of pontoon 22 where it is attached to an L-shaped fitting 154. Hose 156 goes to L-shaped fitting 158 in the forward chamber of pontoon 28. Hose 160 and 162 are connected to Y-shaped fittings 164 and 166, respectively. Hoses 168 and 170 branch from Y-shaped fittings 164 with hose 168 being attached to L-shaped fitting 172 in pontoon 24 and with hose 170 being attached to L-shaped fitting 174 in the rear chamber of pontoon 22. Hoses 176 and 178 branch from Y-shaped fitting 166 with hose 176 going to L-shaped fitting 180 in pontoon 26, and with hose 178 going to L-shaped fitting 182 in the rear chamber of pontoon 28. The L-shaped fittings are sealed into their respective pontoons. Hoses 152, 156, 160, and 162 are connected through a series of valves to a compressed air supply (generally designated as 190, FIG. 6).

Figure 6:
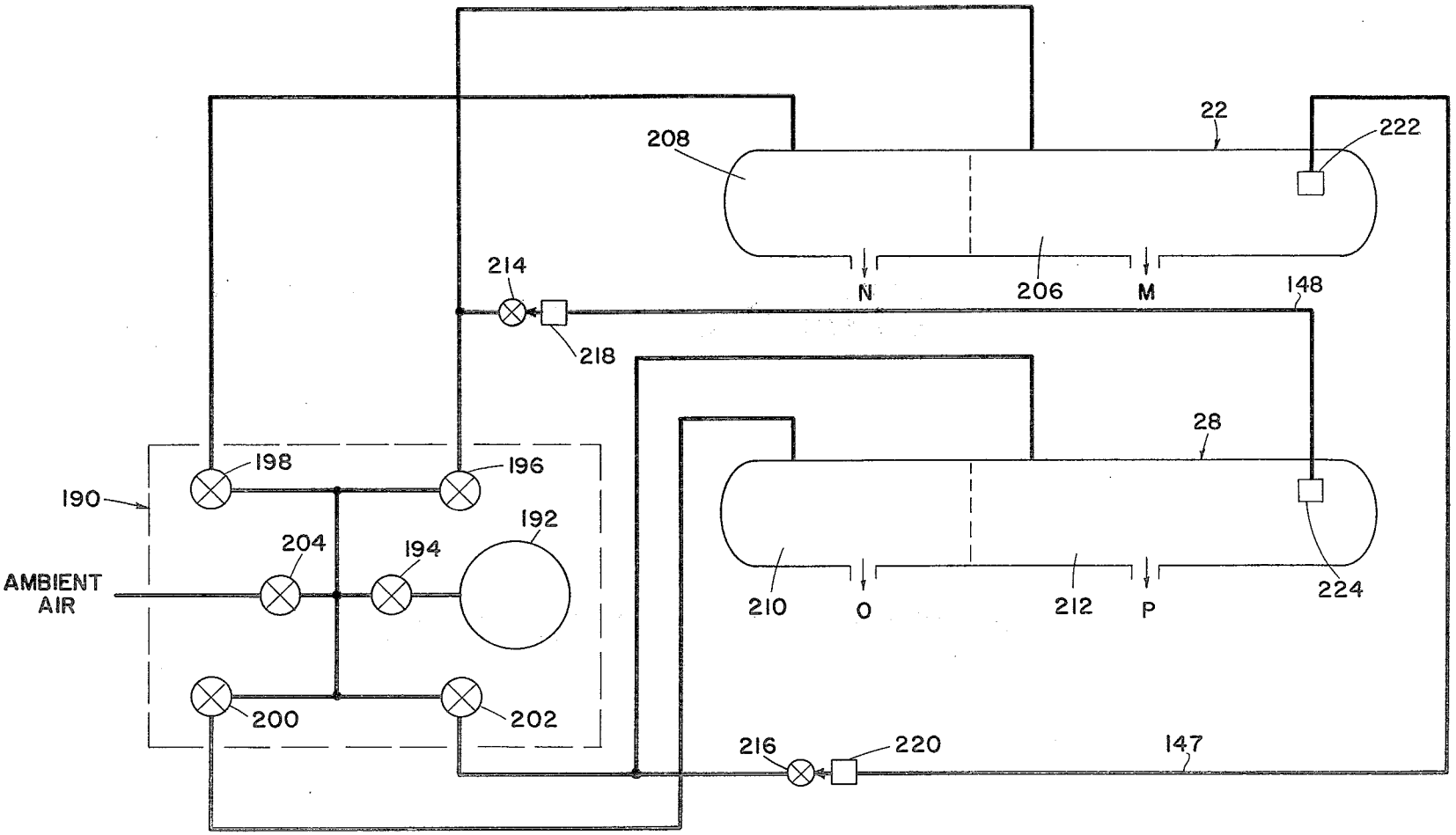
FIG. 6 is a schematic of the chambered pontoons, the valve system and the compressed air supply as constructed according to the present invention.

The valve system controls the flow of air from the compressed air supply 192 to the pontoons (shown in FIG. 6). Interior pontoons 24 and 26 have been omitted from FIG. 6 because they are functionally identical with their respective rear chambers. The compressed air supply 192 is connected to compressor valve 194. The output of valve 194 branches and is connected to valves 196, 198, 200, and 202. Valves 196, 198, 200, and 202 are also attached to exhaust valve 204. Valve 196 is connected (hose 170, FIG. 1) to the rear chamber 206 of pontoon 22 (and through hose 168 to pontoon 24). Valve 198 is connected (hose 152, FIG. 1) to the forward chamber 208 of pontoon 22. Valve 200 is connected (hose 156, FIG. 1) to the forward chamber 210 of pontoon 28. Valve 202 is connected (hose 178, FIG. 1) to the rear chamber 212 of pontoon 28 (and through hose 176 to pontoon 26). Also connected to the rear chamber 206 and 212 (and pontoons 24 and 26) are release valves 214 and 216, with release valve 214 connected to aft chamber 206 (and pontoon 24) and release valve 216 connected to aft chamber 212 (and pontoon 26). A pressure sensitive 218 is engaged with release valve 214 and a similar pressure sensitive device 220 is engaged with release valve 216. The pressure sensitive device 220 is connected (hose 147, FIG. 1) to a cylinder or tube 222 located on the side of pontoon 22. The pressure sensitive device 218 connected (hose 148, FIG. 1) to a cylinder or tube 224. The hoses 147 and 148 are connected to the top ot their respective tubes. The operation of the release valves 214 and 216 and their associated pressure sensitive devices 218 and 220 will be discussed in detail hereinafter.

Assuming all of the valves are in the closed position, the pontoon system in its submerged position, and a watercraft is in the proper position above the pontoon system, operation of the pontoon system is begun by opening valves 198 and 200. Compressor valve 194 is then opened allowing the compressed air from the compressed air supply 192 to flow into forward chambers 208 and 210 forming air pockets therein. The water in forward chambers 208 and 210 is expelled through their respective holes N and O. As the forward portion of the pontoon system is now more buoyant than the rear portion, the front will be elevated and contact the lower portions of the watercraft with the keel pad 114 and the forward portions of hull pads 94 and 100. After the contact by the forward portion of the pontoon system has been accomplished, valves 196 and 202 are opened allowing compressed air to flow into rear chambers 206 and 212 forming air pockets therin. Water is expelled through their respective holes, M and P. (Water is concurrently expelled from pontoons 24 and 26.) The rear portion of the pontoon system will then be elevated and contact the lower portions of the watercraft and as this process continues, more water will be forced from chambers 208, 210, 206, and 212 (and pontoons 24 and 26) raising the watercraft above the surface of the water.

Figure 4:
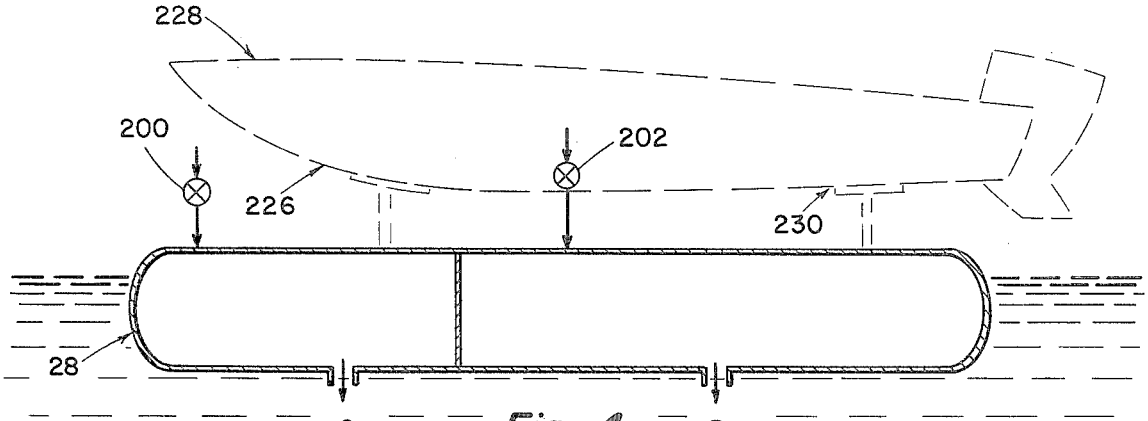
FIG. 4 is a schematic of a chambered pontoon and portions of the valve system with a watercraft disposed above.
Figure 5:
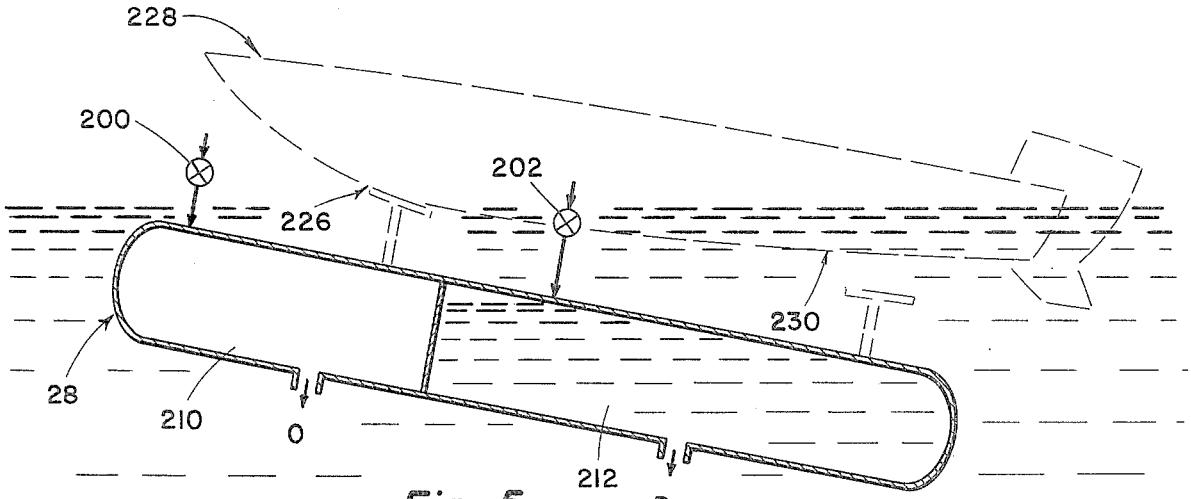
FIG. 5 is a schematic similar to FIG. 4 which shows the pontoon system during its stabilizing operation.

This process is shown in more detail in FIGS. 4 and 5. Only pontoon 28 and its associated valves 200 and 202 are shown but the operation is identical with that of pontoon 22. FIG. 5 shows the approximate position of the pontoon system after it has engaged the forward lower portion 226 of a watercraft 228. All of the water has been expelled from the forward chamber 210. Thus, the watercraft is stabilized by the contact with the forward portion 226 of the watercraft before lifting the entire watercraft, thus reducing the possibility of the watercraft 228 tipping over during the lifting process. FIG. 4 shows the pontoon system with all of the water having been expelled through holes O and P. The pontoon system has now raised the watercraft above the surface of the water (as shown in FIG. 4) and engages not only the lower forward portion 226 of the watercraft but also the aft portion 230 of the watercraft.

Assuming all of the valves are closed, the pontoon system is submerged by opening valves 196, 198, 200, and 202 and then opening exhaust valve 204 which will vent all of the various pontoons and pontoon chambers to the ambient air pressure (as shown in FIG. 6). Water will flow in through holes N,M,O, and P into the chambers reducing the buoyancy of the pontoon system and causing it to submerge. (Of course, the water will also flow into pontoons 24 and 26 through their respective holes which are not shown.) If it was desired to stabilize the watercraft by lowering the rear portion first, valves 198 and 200 would be left closed until it was desired to complete the lowering of the watercraft.

Figure 2:
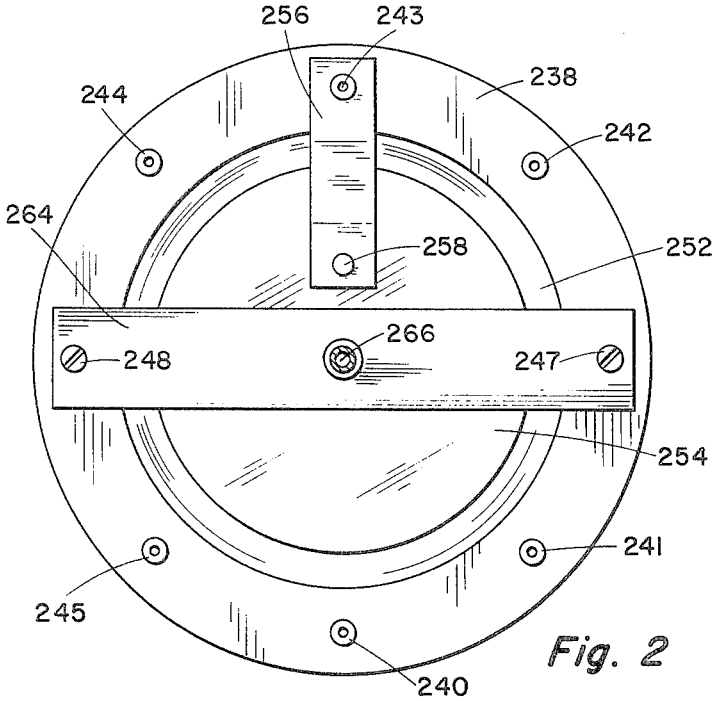
FIG. 2 is a front view of a safety release valve.
Figure 3:
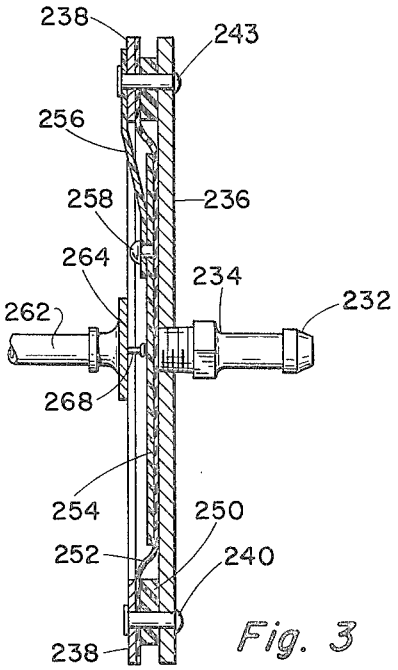
FIG. 3 is a side view of the safety release valve shown in FIG. 2 with portions broken away to reveal internal details.

In the event that one of the rear or aft chambers 206 or 212 or one of the inside pontoons 24 and 26 should develop a leak, an automatically operating safety valve system has been included. Two safety valve systems, one of which is shown in FIGS. 2 and 3, are designated 214 and 218 (FIG. 6) associated with valve 196, and 216 and 220 (FIG. 6) associated with valve 202. (The safety release system 214 and 218 is identical in construction to the safety system 216 and 220.) Two cylinders or tubes are attached to the frame 20. Tube 222 is attached to bracket 38 (FIG. 1) and tube 224 is attached to bracket 50 (FIG. 1). Tubes 222 and 224 are closed except for openings at the top for connection to hoses 147 and 148, respectively, and an opening at the bottom (not shown). When the tubes 222 or 224 are at a predetermined depth in the water, a safety release valve is actuated and the opposite rear chamber and its associated interior pontoon, either 24 or 26, is vented to the ambient air which will release the compressed air from said pontoons. For example, if pontoon 22 developed a slow leak, tube or cylinder 222 would be gradually lowered into the water. When it reaches the predetermined depth, air would be vented from the rear chamber of pontoon 28 and pontoon 26.

Referring now to FIGS. 2 and 3, the safety release systems will be explained in detail with reference to the above example. A hose would be placed over the end of tubular fitting 234 which expands forming a nib 232 for holding the hose thereon. In the above example, the hose would be hose 147. The tubular fitting 234 is sealed into a flat plate 236. A ring clamp 238 and its associated rivets 240 through 245, screws 247 and 248, a circular ring type gasket 250, a circular diaphragm 252 made of an elastic material, and the tubular fitting 234 are connected to form an airtight pocket except for the opening to hose 147. The gasket 250 is placed against plate 236. The diaphragm 252 is placed over the the gasket 250, and the ring clamp which is approximately the same diameter as the gasket 250 is placed against the diaphragm above the gasket.

The ring clamp, diaphragm, gasket and flat plate are provided with suitable holes for accepting rivets 240 through 245 and screws 247 and 248 which tighten the structure together forming an airtight seal. A rigid circular plate or valve lifter 254 is positioned against the side of the diaphragm opposite to the air pocket formed between the diaphragm and the tubular fitting 234. The circular plate 254 is held in place against the diaphragm by a spring clamp 256 which is attached at one end to ring clamp 238 by rivet 243. The spring clamp 256 is attached to the circular plate 254 by a rivet 258 at its opposite end.

Another tubular fitting 262 is mounted on a rectangular plate 264. Rectangular plate 264 is provided with alignment holes and is attached to ring clamp 238 by passing screws 247 and 248 through those alignment holes. Mounted in tubular fitting 262 is a standard spring type stem valve (not shown in detail but generally designated by the numeral 266). This spring type stem valve is one of the release valves (designated 214 and 216 in FIG. 6). The fitting 262 would, in the above example, be attached by a conduit or hose (not shown) to hose 162 which goes to the pontoons on the opposite side. The stem 268 of the valve 266 is either engaged with or close to the circular plate 254. The tube, hose, and diaphragm form a pressure sensing device. The stem valve and its associated connection to a hose going to a portion of the pontoons form a safety release device.

The pressure detected by the tube or cylinder 222 is transmitted by hose 147 to the diaphragm 252. The diaphragm presses against the circular plate 254 which in turn engages the stem 268. As the pressure detected by cylinder 222 increases, the pressure exerted by the diaphragm against plate 254 and in turn against stem 268 will increase. When the predetermined depth is reached, stem 268 will have moved a sufficient distance against the spring in the stem valve (not shown) that the stem valve 266 will be actuated venting the rear chamber 212 of pontoon 28, and pontoon 26 to the ambient air. This will release the air from the pontoons thus lowering the rear portion of the pontoon system into the water gradually.

The operation and construction of the release valve 214 in combination with pressure detection device 218 cylinder or tube 224 and hose 148 is similar. Fitting 234 would be connected to hose 148 and fitting 262 is connected through a hose or conduit (not shown) to hose 160. If the pontoon 28, for example, developed a leak and began to lower into the water, when it reached the predetermined depth, release valve 214 would be actuated, and it would vent the rear chamber of pontoon 22 and pontoon 24 to the ambient air. This would gradually lower the opposite side of the pontoon system into the water. When the side now vented by a release valve reaches the predetermined depth, the release valve on the opposite side will be actuated and begin to gradually lower the other side into the water. Therefore, once this lowering process has begun it will continue until substantially all of the air is released from both rear chambers and both interior pontoons. The forward chambers will, of course, remain filled with air and therefore more buoyant, thus maintaining the stability of the watercraft.

The pontoon system may be utilized independent of any other structure; however, if it is desired to attach the frame 20 to another structure, slide brackets 270 and 272 which extend vertically are provided. Slide bracket 270 is attached to walkway 139 and pontoon bracket 48 and slide bracket 272 is attached to walkway 139 and pontoon bracket 50. Rods 274 and 276 are attached between the ends of slide bracket 270 and 272, respectively. Brackets (not shown) are attached to the dock for engaging rods 274 and 276 and form a guide or channel which allows frame 20 to freely move in a vertical direction while restraining horizontal movement.

The frame 20 may be leveled by releasing or directing gas to and from the various chambers and pontoons. For example, if the side with pontoon 22 was higher than the side with pontoon 28, valves 198, 196, and 204 could be opened and air released from pontoon 22 and pontoon 24 until the frame is level.

The present invention shows a pontoon system with chambered pontoons. It should be noted, however, that the pontoon system may be constructed with separate pontoons or tanks positioned in approximately the same location as the chambers of the chambered pontoons. It is also possible to place pontoons substantially perpendicular to those shown in the preferred embodiment which would allow the water to be forced from the forward pontoon thus raising the frame to engage the lower portion of the front part of the watercraft. Similar results could be obtained by various combinations of chambered and unchambered pontoons set at various angles on the frame, because it is the distribution and control of the application of the lift which is most important.

SUMMARY OF OPERATION

The pontoon system is raised by expelling the water from the forward chambers of the pontoons and engaging the lower portions of the forward part of the watercraft. Thus, the watercraft is stabilized prior to the water being expelled from the rear chambers of the pontoon system and the other pontoons and the supporting completed. The water is expelled from the pontoons or chambers by the use of compressed air directed through a series of valves.

When it is desired to lower the watercraft into the water, the air contained in the pontoons is released through the same series of valves by venting the valve system to the ambient air. The pontoons and chambers may be either vented at the same time or the rear chambers and their associated interior pontoons may be vented to the ambient air which will lower the rear portion of the watercraft into the water. The forward chambers may be subsequently vented thus lowering the forward portion of the watercraft into the water.

Whereas the present invention has been described in particular relation to the drawings attached hereto, it should be understood that other and further modifications, apart from show or suggested herein, may be made within the spirit and scope of this invention.

What is claimed is:

1. Pontoon system for supporting watercraft on a body of water comprising a longitudinally extending frame having a forward end, a rear end, a first side, and a second side, a first pontoon attached to said first side of said frame and having a first forward chamber and a first rear chamber separate from said first forward chamber, a second pontoon attached to said second side of said of frame and having a second forward chamber and a second rear chamber separate from said second forward chamber, a third pontoon attached to said frame adjacent to said first pontoon and disposed toward the longitudinal center line of said frame, a fourth pontoon attached to said frame between said second and third pontoons, said third and fourth pontoons and each chamber of said first and second pontoons having a lower opening in communication with the water, a first hose connected to said first forward chamber, a second hose connected to said second forward chamber, a third hose connected to said first rear chamber and said third pontoon, a fourth hose connected to said second rear chamber and said fourth pontoon, each hose being also connected to a valve for conducting gas under pressure into pontoons and chambers for forming gas pockets therein for forcing water out of the pontoons and chambers through the lower openings thereof thereby elevating said frame whereby the frame will engage lower portions of a watercraft for elevation thereof to a position out of the water, each valve also being adapted to release gas from said pontoons and chambers selectively for lowering said frame whereby the watercraft is lowered into the water, a compressor supplying gas under pressure, a compressor valve connected to said compressor for allowing the directing of gas to said pontoons and chambers, a first valve connected between said first hose and said compressor valve, a second valve connected between said second hose and said compressor valve, a third valve connected between said third hose and said compressor valve, a fourth valve connected between said fourth hose and said compressor valve, each first, second, third and fourth valve having an open and a closed position for selectively directing gas under pressure from said compressor into its respective hose, and an exhaust valve connected to said first valve, said second valve, said third valve, and said fourth valve having an open and closed position and provided with an outlet to ambient air for selectively releasing gas from said pontoons and chambers; and said compressor valve, said first valve and said second valve being opened initially for directing gas to said first forward chamber and said second forward chamber allowing said forward end of said frame to engage the lower portion of the forward end of the watercraft adjacent said forward ends of said frame, said third valve and said fourth valve being subsequently opened directing gas under pressure to said first rear chamber, said second rear chamber, said third pontoon, and said fourth pontoon for completing the supporting of said watercraft on the body of water; and including a first tube attached vertically to said first side of said frame and having a closed top and an opening at the bottom for sensing pressure, a first diaphragm housing, a first circular diaphragm mounted in said first housing with peripheral edges of said first diaphragm engaged by said first housing, a fifth hose communicating with the top of said first tube, said fifth hose also communicating with said first housing and forming an airtight pocket with one side of said first diaphragm, a second tube attached vertically to said second side of said frame and having a closed top and an opening at the bottom for sensing pressure, a second circular diaphragm housing, a second diaphragm mounted in said second housing with peripheral edges of said second diaphragm engaged by said second housing, a sixth hose communicating with the top of said second tube, said sixth hose also communicating with said second housing and forming an airtight pocket with one side of said second diaphragm, a first stem valve mounted on said first housing, a first stem projecting from one end of said first stem valve toward the other side of said first diaphragm opposite to said one side thereof and movable for opening said first stem valve, a first circular plate mounted on said other side of said first diaphragm and engageable with said first stem when urged toward said first stem by said first diaphragm for opening said first stem valve when the pressure in said first tube exceeds a predetermined value, said first stem valve opening to ambient air at the stem end thereof, a first conduit means connected to said stem valve at an end thereof opposite to said stem end, said first conduit means also being connected to said fourth hose, a second stem valve mounted on said second housing, a second stem projecting from one end of said second stem valve toward the other side of said second diaphragm opposite to said one side thereof and movable for opening said second stem valve, a second circular plate mounted on said other side of said second diaphragm and engageable with said second stem when urged toward said second stem by said second diaphragm for opening said second stem valve when the pressure in said second tube exceeds a predetermined value, said second stem valve opening to ambient air at the stem end thereof, a second conduit means connected to said second stem valve at an end thereof opposite to said stem end, said second conduit means also being connected to said third hose.

2. Pontoon system for supporting watercraft above a body of water comprising a longitudinally extending frame having a longitudinally extending center line, a forward end and a rear end, a plurality of longitudinally extending pontoons held by said frame in substantially parallel spaced relation and substantially parallel to the center line of said frame, each pontoon having a forward end and a rear end, each pontoon having a plurality of longitudinally spaced and separate chambers, each chamber having a lower opening in communication with the water, valve means connected to said chambers for selectively directing gas under pressure into chambers for forming gas pockets therein to force water out of the chambers through the lower openings thereof thereby elevating said frame whereby the frame will engage lower portions of a watercraft for elevation thereof to a position out of the water, said valve means also being adapted to release gas from said chambers selectively for lowering said frame whereby the water craft is lowered into water, and a compressor for supplying gas under pressure to said valve means, said means also adapted to direct gas initially to the chambers at the the forward ends of said pontoons for allowing said forward end of said frame to engage the lower portion of a forward end of the watercraft adjacent said forward end of said frame to elevate the forward end of said watercraft for stabilizing the watercraft prior to the elevation of the entire watercraft; said valve means subsequently also adapted to direct gas under pressure to all of said chambers for completing the supporting of said watercraft above the body of water.

3. Pontoon system for supporting watercraft on a body of water as set forth in claim 2 wherein said valve means releases gas from said pontoon means in such manner as to lower a rear end of said watercraft opposite from said forward end thereof prior to lowering the entire watercraft.

4. Pontoon system for supporting watercraft on a body of water comprising a longitudinally extending frame having a forward end and a rear end, pontoon means carried by the frame and having a forward end and a rear end, said pontoon means having a plurality of longitudinally spaced and separate chambers, each chamber having a lower opening in communication with the water, valve means connected to said chambers for selectively directing gas under pressure into said chambers for forming gas pockets therein to force water out of the chambers through the lower openings thereof thereby elevating said frame whereby the frame will engage lower portions of a watercraft for elevation thereof to a position out of the water, said valve means also being adapted to release gas from said chambers selectively for lowering said frame whereby the watercraft is lowered into the water, and a compressor for supplying gas under pressure to said valve means, said valve means directing gas initially to said forward end of said pontoon means for allowing said forward end of said frame to engage the lower portion of a forward end of the watercraft adjacent said forward end of said frame to elevate the forward end of said watercraft for stabilizing the watercraft prior to the elevation of the entire watercraft; said valve means subsequently directing gas under pressure to all of said chambers for completing the supporting of said watercraft on the body of water, said pontoon means comprising a pair of longitudinally extending pontoons held by said frame in substantially parallel spaced relation and substantially parallel to the center line of said frame, each pontoon having a pair of chambers defining a forward chamber and a rear chamber, said system also including a first pressure sensing device attached to a first side of said frame adjacent the rear end thereof for sensing the depth of said first side of said frame in the water, a second pressure sensing device attached to a second side of said frame opposite to said first side thereof adjacent the rear end thereof for sensing the depth of said second side of said frame in the water, and wherein said valve means includes a first safety release means responsive to said first pressure sensing device and connected to the rear chamber of a second pontoon located adjacent to said second side of said frame for venting gas therefrom when said first pressure sensing device senses a predetermined depth, and a second safety release means responsive to said second pressure sensing device and connected to the rear chamber of a first pontoon located adjacent to said first side of said frame for venting gas therefrom when said second pressure sensing device senses a predetermined depth.

5. Pontoon system for supporting watercraft on a body of water as set forth in claim 4 wherein said first pressure sensing device includes a first tube attached vertically to said first side of said frame and having a closed top and an opening at the bottom for sensing pressure, a first diaphragm housing, a first circular diaphragm mounted in said first housing with peripheral edges of said first diaphragm engaged by said first housing, a first hose communicating with the top of said first tube, said first hose also communicating with said first housing and forming an airtight pocket with one side of said first diaphragm; wherein said second sensing device includes a second tube attached vertically to said second side of said frame and having a closed top and an opening at the bottom for sensing pressure, a second diaphragm housing, a second circular diaphragm mounted in said second housing with peripheral edges of said second diaphragm engaged by said second housing, a second hose communicating with the top of said second tube, said second hose also communicating with said second housing and forming an airtight pocket with one side of said second diaphragm; wherein said first safety release means includes a first stem valve mounted on said first housing, a first stem projecting from one end of said first stem valve toward the other side of said first diaphragm opposite to said one side thereof and movable for opening said first stem valve, a first circular plate mounted on said other side of said first diaphragm and engageable with said first stem when urged toward said first stem by said first diaphragm for opening said first stem valve when the pressure in said first tube exceeds a predetermined value, said first stem valve opening to ambient air at the stem end thereof, a first conduit means connected to said stem valve at an end thereof opposite to said stem end, said first conduit means also being connected to rear chamber of said second pontoon; and wherein said second safety release means includes a second stem valve mounted on said second housing, a second stem projecting from one end of said second stem valve toward the other side of said second diaphragm opposite to said one side thereof and movable for opening said second stem valve, a second circular plate mounted on said other side of said second diaphragm and engageable with said second stem when urged toward said second stem by said second diaphragm for opening said second stem valve when the pressure in said second tube exceeds a predetermined value, said second stem valve opening to ambient air at the stem end thereof, a second conduit means connected to said second stem valve at an end thereof opposite to said stem end, said second conduit means also being connected to rear chamber of said first pontoon.

6. Pontoon system for supporting watercraft above a body of water comprising a longitudinally extending frame having a longitudinally extending center line, forward end and a rear end, a plurality of longitudinally extending pontoons carried by said frame in substantially parallel relation with the longitudinal center line of said frame, each pontoon having a plurality of longitudinally spaced and separate chambers each having a lower opening in communication with the water, valve means for selectively directing gas under pressure into any combination of said plurality of chambers of said pontoons thereby forming an air pocket therein to force water out of said pontoons through the lower openings thereof thereby elevating said frame whereby said frame will engage the lower portions of a watercraft for elevation thereof to a position out of the water, said valve means also being adapted to release gas from said plurality of pontoons selectively for lowering said frame thereby lowering said watercraft into the water and a compressor for supplying gas under pressure to said valve means; and wherein a first portion of each pontoon is disposed at said forward end of said frame and a second portion of each pontoon is disposed at said rear end of said frame, said valve means also adapted to direct gas initially to said first chambers in said first portions of said plurality of pontoons for allowing said forward end of said frame to engage the lower portion of a forward end of said watercraft adjacent to said forward end of said frame elevating said forward end of said watercraft for stabilizing the watercraft prior to the elevation of the entire watercraft, said valve means subsequently also adapted to direct gas under pressure to all of said chambers of said pontoons for completing the supporting of said watercraft above the body of water.

7. Pontoon system for supporting watercraft on a body of water as set forth in claim 6 wherein said valve means releases gas from said second portion of said pontoons to lower a rear end of said watercraft adjacent to said rear end of said frame prior to lowering the entire watercraft.

8. Pontoon system for supporting watercraft on a body of water as set forth in claim 6 including a first pressure sensing device attached to a first side of said frame adjacent the rear end thereof for sensing the depth of said first side of said frame in the water, a second pressure sensing device attached to a second side of said frame opposite to said first side thereof adjacent the rear end thereof for sensing the depth of said second side of said frame in the water, and wherein said valve means includes a first safety release means responsive to said second pressure sensing device and connected to portion of said second portion of said plurality of pontoons located adjacent to said first side of said frame for venting gas therefrom when said second pressure sensing device senses a predetermined depth, and a second safety release means responsive to said first pressure sensing device and connected to portion of said second portion of said plurality of pontoons located adjacent to said second side of said frame for venting gas therefrom when said first pressure sensing device senses a predetermined depth.

* * * * *